US005433557A

United States Patent [19]

Houghton

[11] Patent Number: 5,433,557

[45] Date of Patent: Jul. 18, 1995

[54] METHOD FOR UNDERPINNING AN EXISTING FOOTING

[75] Inventor: Robert C. Houghton, Bedord, N.H.

[73] Assignee: Spencer, White & Prentis Foundation Corporation, Swansea, Mass.

[21] Appl. No.: 173,076

[22] Filed: Dec. 27, 1993

[51] Int. Cl.[6] ..... E02D 27/48; E02D 35/00

[52] U.S. Cl. ..... 405/230; 405/229

[58] Field of Search ..... 405/229, 230, 231, 232

[56] References Cited

U.S. PATENT DOCUMENTS

| | | | |
|---|---|---|---|
| 570,370 | 10/1896 | Breuchaud | 405/230 |
| 1,063,869 | 6/1913 | Goldsborough | 405/230 |
| 1,451,799 | 4/1923 | Youngblood | 405/230 |
| 3,091,938 | 6/1963 | Schnabel | 405/230 |
| 4,834,582 | 5/1989 | Bullivant . | |
| 5,011,336 | 4/1991 | Hamilton et al. . | |
| 5,116,355 | 5/1992 | Freeman, III . | |

FOREIGN PATENT DOCUMENTS

| | | | |
|---|---|---|---|
| 775499 | 12/1934 | France | 405/230 |

*Primary Examiner*—David H. Corbin

*Attorney, Agent, or Firm*—Salter & Michaelson

[57] ABSTRACT

A method for underpinning an existing footing of a building structure includes the steps of driving or drilling pile members into the ground on opposing sides of the footing, and forming concrete compression blocks on the opposing sides of the footing so that the concrete compression blocks are engaging relation with the footing and so that the concrete blocks are supported on the pile members. The method further includes the steps of drilling horizontal openings through the compression blocks and footing and extending post-tensioning strands through the openings. The post-tensioning strands are then tensioned to a predetermined load so that the compression blocks are urged into firm engaging and compressing relation with the footing. The earth beneath the footing and the compression blocks is then excavated wherein the footing and compression blocks are supported by the pile members. The load of the building is effectively transferred from the footing to the compression blocks by means of friction. A new foundation portion can then be formed directly beneath the existing footing while the footing is supported by the pile members.

6 Claims, 2 Drawing Sheets

METHOD FOR UNDERPINNING AN EXISTING FOOTING

BACKGROUND OF THE INVENTION

The instant invention relates to construction techniques and more particularly to a method for underpinning an existing footing so that a new foundation portion may be constructed directly beneath the footing.

In the restoration of old buildings it is often necessary to construct a new foundation portion underneath an existing footing in order to support the building structure. One problem associated with installing a new foundation portion is that the existing footing of the building structure must be supported while the ground underneath the footing is excavated to make room for the new foundation portion. In order to be effective in supporting the building load, the new foundation portion should be constructed directly below the existing footing so that the existing footing rests directly on the new foundation portion. However, the heretofore known methods and apparatus for underpinning a building structure typically include one or more bracing or support members which are installed underneath the footing in order to support the footing while excavation takes place. In this connection, the U.S. Patents to Bullivant U.S. Pat. No. 4,834,582; Hamilton et al U.S. Pat. No. 5,011,336; and Freeman III U.S. Pat. No. 5,116,355 represent the closest prior art to the subject invention of which the applicant is aware. Each of the above-referenced patents discloses an underpinning system in which support elements are installed beneath the footing in order to support the footing during excavation. It can be seen that the support elements of the prior art interfere with the excavation processes and further interfere with the construction of a new foundation portion beneath the footing. More specifically, the new foundation portion must be constructed in pieces or sections in order to fit around the underpinning support members.

SUMMARY OF THE INVENTION

The instant invention provides a novel method of underpinning an existing footing so that a new foundation portion may be constructed directly beneath the existing footing without any obstructions. Briefly, the instant method comprises the steps of drilling or driving pile members into the ground on opposing sides of the footing, and forming concrete compression blocks on the opposing sides of the footing so that the concrete compression blocks are in engaging relation with the footing and so that the concrete blocks are supported on the pile members. The method further includes the steps of drilling horizontal openings through the concrete blocks and footing, and extending post-tensioning elements through the openings. The post-tensioning elements are then tensioned to a predetermined load so that the compression blocks are urged into firm engaging and compressing relation with the footing. Thereafter, the ground beneath the footing is excavated wherein the footing is supported by the pile members. The new foundation portion can then be constructed while the footing is supported by the pile members. In operation, the load of the building is transferred from the footing to the compression blocks by means of friction which is induced by the post-tensioning elements, and the compression blocks are supported by the pile members. Since there are no underpinning structures beneath the footing, a new foundation portion can be formed without obstruction.

Accordingly, it is an object of the instant invention to provide a method of underpinning an existing footing so that a new foundation portion can be constructed directly beneath the existing footing without interference from any underpinning structures.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
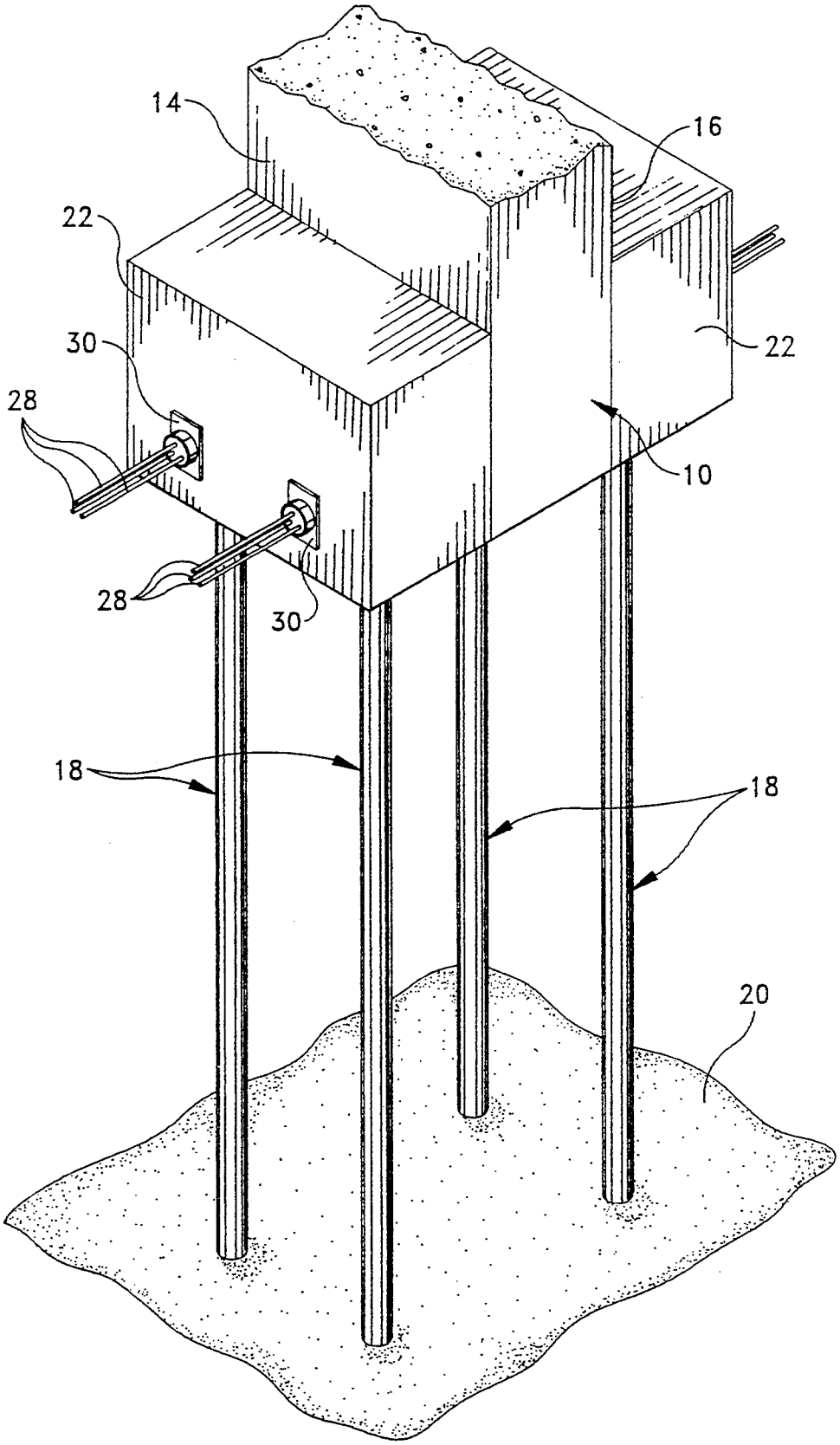
FIG. 1 is a perspective view of a footing which is underpinned according to the teachings of the instant invention.
Figure 2:
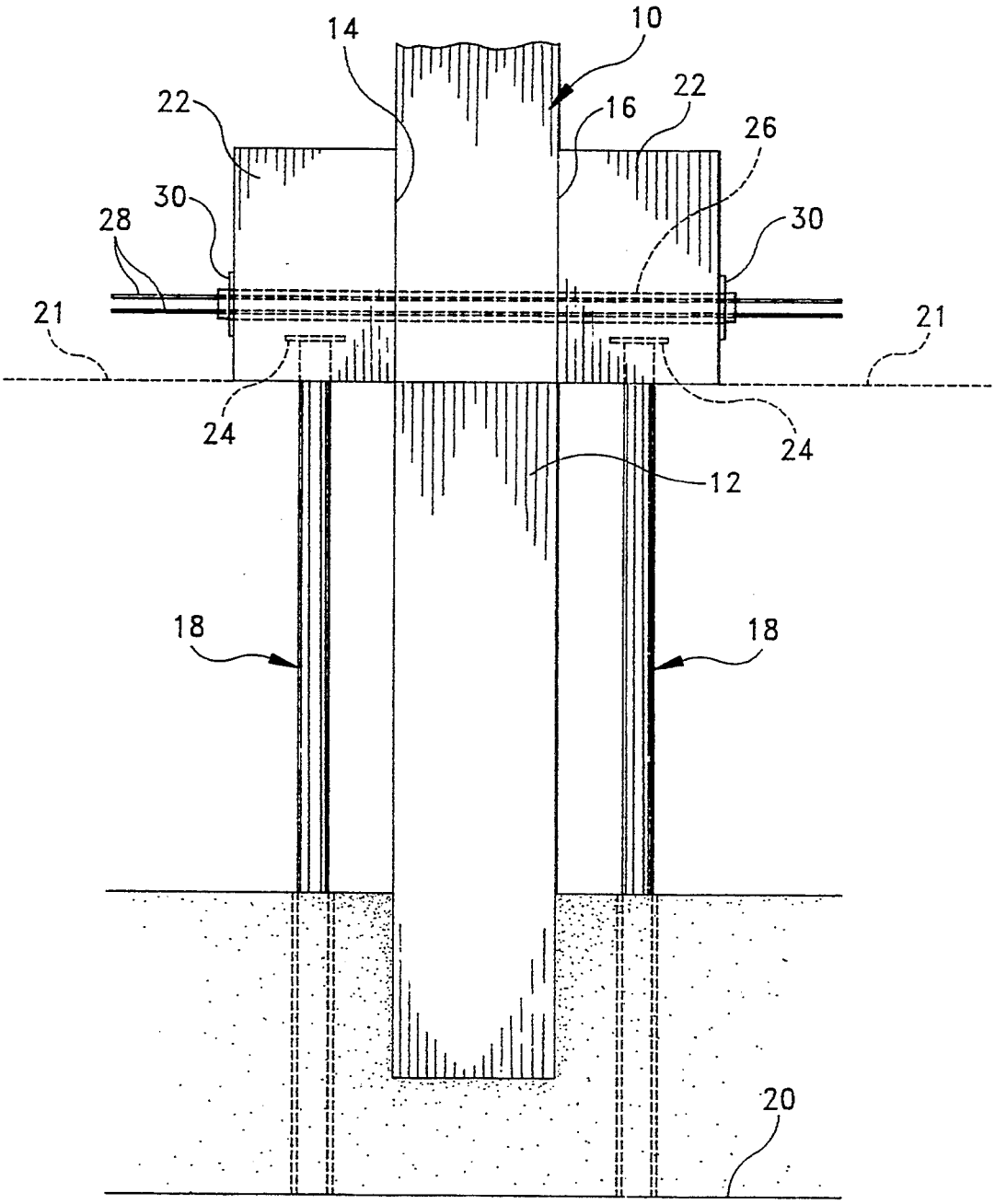
FIG. 2 is a side view thereof.

Referring now to the drawings, FIGS. 1 and 2 illustrate a footing 10 which is underpinned according to the method of the instant invention. As will hereinafter be more fully described, the instant method enables the earth underneath the footing 10 to be excavated and a new foundation portion 12 (FIG. 12) constructed underneath the footing 10 without obstruction from the underpinning system. The footing 10 is generally square in configuration and includes first and second opposing sides 14 and 16 respectively. The method comprises the steps of positioning at least two vertical pile members generally indicated at 18 in the ground adjacent to the first and second sides, 14 and 16, of the footing 10. The pile members 18 are positioned in the ground by any suitable means, such as by driving, drilling, or digging, so that they rest on a firm bearing stratum 20 beneath the building structure. In this manner, the pile members 18 form a stable foundation for the underpinning system. In the instant embodiment, the pile members 18 preferably comprise mini-piles, however, large diameter drilled piles, driven piles, caissons, and hand-dug piles are also suitable within the scope of the instant method. The pile members 18 are positioned so that the top ends thereof are exposed above ground level 21 adjacent to the footing (FIG. 2). The method further comprises the step of forming a concrete compression block 22 adjacent to the first and second sides 14 and 16, of the footing 10. The concrete compression blocks 22 are preferably reinforced with steel reinforcing bars and are formed by conventional methods, such as by constructing wood forms and then pouring the concrete into the forms. The forms for the compression blocks 22 are preferably positioned so that the top ends of the pile members 18 extend into the forms. In this regard, the top ends of the pile members 18 are embedded within the compression blocks 22 when the comcrete is poured into the forms. It is pointed out that the top ends of the pile members 18 include a flange portion 24 which provides an enlarged load bearing surface on top of the pile member 18. The compression blocks 22 are further positioned so that they are in adjacent engaging relation with the first and second sides 14 and 16, of the footing 10. The method further comprises the step of drilling a plurality of horizontal openings 26 through the compression blocks 22 and the footing 10. A plurality of post-tensioning elements 28 are then extended through the openings 26 and the post-tensioning elements 28 are tensioned to a predetermined load so that the compression blocks 22 are urged into firm engaging and compressing relation with the sides 14 and 16 of the footing 10. The post-tensioning elements are secured in position by any suitable retainer means 30 to maintain the predetermined tension. In the instant embodiment, the post-tensioning elements 28 preferably comprise strand tendons, however, other tensioning elements, such as steel reinforcing bars are also contemplated within the scope of the invention.

After the pile members 18 and compression blocks 22 are fixed in position and tensioned, the earth beneath the footing 10 and compression blocks 22 is excavated so that the new foundation portion 12 can be installed. In operation, the load of the building is effectively transferred from the footing 10 to the compression blocks 22 by friction which is induced by the post-tensioning elements 28. The footing 10 and the compression blocks 22 are thus supported by the pile members 18 when the earth beneath the footing 10 is excavated. Since the vertical pile members 18 are positioned outside the perimeter of the footing 10, the excavation work underneath the footing 10 may be carried out without any obstruction. Likewise, when the new foundation portion 12 is constructed beneath the footing 10, there is no interference from pile members 18 or any other supporting structure.

While the footing 10 illustrated in FIGS. 1 and 2 is generally square in configuration, it is contemplated that other various and diverse shaped footings may also be supported according to the teachings of the instant invention. Since the footing 10 is essentially supported by friction which is induced by the post-tensioning elements 28, it is necessary that the compression blocks 22 be formed with engagement surfaces or wall that will conform with the outer sides of the footing. For example, a round footing or column may be supported by forming the compression blocks 22 with semicircular inner walls, so that when the post-tensioning elements 28 are tensioned, the compression blocks 22 are urged into firm engaging and compressing relation with the sides of the round footing or column.

It can thus be seen that the instant method is simple to implement, that it takes less time than the prior art methods, and that it results in a more stable foundation portion. The compression blocks 22 effectively transfer the load of the footing 10 to the pile members 18 by friction so that the area underneath the footing 10 may be clear of any interfering structures. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

I claim:

1. A method of underpinning an existing footing of a building structure comprising the steps of:

positioning at least two vertical pile members in the ground adjacent to first and second opposing sides of said footing, said pile members resting on a stable ground formation;

forming a compression block adjacent each of said first and second sides of said footing, said compression blocks being located in engaging relation with said first and second sides of said footing and being supported on said pile members;

forming a plurality of horizontal openings through said compression blocks and said footing;

extending a plurality of post-tensioning elements through said openings;

tensioning said post-tensioning elements to a predetermined load so that said compression blocks are urged into firm engaging and compressing relation with said footing; and excavating the earth beneath said footing and said compression blocks wherein said compression blocks and said footing are supported by said pile members, said downward load of said building being transferred from said footing to said compression blocks by friction induced by said post-tensioning elements.

2. In the method of claim 1, said steps of forming said compression blocks comprising the steps of constructing wooden forms adjacent to the sides of said footing, and pouring concrete into said forms, said forms further being constructed so that said top ends of said pile members extend into said forms and are imbedded in said concrete blocks when said concrete is poured.

3. In the method of claim 1, said step of forming said compression block further comprising the step of reinforcing said concrete with steel reinforcing bars.

4. The method of claim 1 further comprising the step of constructing a new foundation portion beneath said footing while said footing is supported by said pile members.

5. In the method of claim 1 said step of positioning said pile members in the ground comprising driving said pile members into the ground.

6. In the method of claim 1, said step oft positioning said pile members in the ground comprising drilling said pile members into the ground.

* * * * *